US008827592B2

(12) United States Patent
Frelich et al.

(10) Patent No.: US 8,827,592 B2
(45) Date of Patent: Sep. 9, 2014

(54) ADJUSTABLE PUSH-ROLLER

(75) Inventors: Toby A. Frelich, St. Michael, MN (US); Rick L. Mings, Andover, MN (US); Ryan T. Thiesse, Ostego, MN (US); Chad M. Thiesse, Brooklyn Park, MN (US); Aaron M. Case, St. Michael, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/482,320

(22) Filed: May 29, 2012

(65) Prior Publication Data

US 2013/0322965 A1 Dec. 5, 2013

(51) Int. Cl.
*E01C 19/18* (2006.01)
*B60R 19/32* (2006.01)
*B60R 19/38* (2006.01)

(52) U.S. Cl.
USPC ..... 404/108; 293/118; 293/131

(58) Field of Classification Search
USPC ..... 404/108; 14/69.5; 414/389, 401; 293/24–26, 118, 119, 131, 134
See application file for complete search history.

(56) References Cited

U.S. PATENT DOCUMENTS 1,386,452 A * 8/1921 Dotzer et al. ..... 293/131
1,497,653 A * 6/1924 Coote ..... 293/131
1,704,995 A * 3/1929 Williams ..... 293/131
1,777,342 A * 10/1930 Williams ..... 293/131
3,250,191 A * 5/1966 Potts ..... 404/108
3,774,950 A * 11/1973 Weller ..... 293/131
3,834,686 A * 9/1974 Moritz et al. ..... 267/116
3,992,047 A * 11/1976 Barenyi et al. ..... 293/9
4,955,754 A 9/1990 Smith
5,004,394 A * 4/1991 Goodwin et al. ..... 414/346
5,624,143 A * 4/1997 Waldschmitt ..... 293/118
6,523,872 B2 * 2/2003 Breed ..... 293/119
6,575,509 B1 * 6/2003 Golden ..... 293/119

FOREIGN PATENT DOCUMENTS

EP 0562586 A2 3/1993
JP 7-102520 A 4/1995

* cited by examiner

*Primary Examiner* — Abigail A Risic
(74) *Attorney, Agent, or Firm* — Leydig, Voit & Mayer, Ltd.

(57) ABSTRACT

A machine with a chassis and a push-roller assembly connected to the chassis. The push-roller assembly engages a vehicle, has a support frame with rollers, and support arms with a chassis end connected to the support frame and a linkage end connected to the chassis. The support frame moves relative to the chassis when the support arm pivots with respect to the chassis and the support frame. The machine includes an actuator controller associated with an actuator in the push-roller assembly. The actuator is connected to the support arm, causing the support arm to pivot with respect to the chassis and support frame, displacing the support frame relative to the chassis.

12 Claims, 9 Drawing Sheets

ADJUSTABLE PUSH-ROLLER

TECHNICAL FIELD

This patent disclosure relates generally to machines that interface with trucks and, more particularly, to asphalt pavers.

BACKGROUND

During industrial paving operations, many different types, sizes and shapes of trucks deliver paving material to paving equipment for application to roads or other surfaces. The trucks delivering the paving material must back up toward a paving machine such that the truck operator can tilt the truck's bed into a position to unload paving material into a receptacle on the paving machine. Some paving machines have push-rollers that are attached close to an end of the receptacle. When the paving machine is set up correctly, the tires of a reversing truck carrying paving material will contact the push-rollers when the truck is at a proper distance for its bed to unload material into the receptacle. Different trucks, however, require the push-rollers to be positioned at different distances to ensure proper positioning of the truck bed for material transfer.

Prior push-rollers require manual horizontal adjustments of the push-roller to accommodate trucks of different shapes and sizes transferring paving material to a paving machine. Manual adjustment of the push-roller requires unbolting portions of the push-roller and manually repositioning it based on the particular truck making a material delivery. This process can be time consuming and laborious, increasing the time and personnel required to complete a paving operation.

Powered push-rollers have been proposed in the past with mixed results. For example, JP7102520A discloses a push-roller that can be moved back and forth by a hydraulic cylinder relative to the machine. The disclosed push-roller retracts when the tire of a dump truck contacts the push-roller and locks in place at a predetermined distance. However, the push-roller must be reset for each truck that engages the paving machine. For example, if the position of the push-roller is not reset between trucks, then an incorrect distance can be used.

SUMMARY

The disclosure describes, in one aspect, a machine comprising a chassis and a push-roller assembly connected to the chassis. The push-roller assembly engages a vehicle and comprises a support frame, at least one roller connected to the support frame, and at least one support arm that has a chassis end and a linkage end. The linkage end is pivotally connected to the support frame and the chassis end is pivotally connected to the chassis. The support frame is movable relative to the chassis when the support arm pivots with respect to the chassis and the support frame. The push-roller assembly also has an actuator connected to the support arm. The actuator can cause the support arm to pivot with respect to the chassis and support frame such that the support frame is displaceable relative to the chassis. The machine also has an actuator controller that is operatively associated with the actuator.

In another aspect, the disclosure describes a push-roller assembly adapted to engage a vehicle. The push-roller assembly comprises a support frame, at least one roller connected to the support frame, and at least one support arm including a chassis end and a linkage end. The linkage end is pivotally connected to the support frame and the chassis end is adapted to be pivotally connected to a chassis. The support frame is movable relative to the chassis when the support arm pivots with respect to the chassis and support frame. The push-roller assembly also has an actuator connected to the support arm. The actuator is adapted to cause the support arm to pivot with respect to the chassis and the support frame such that the support frame is displaceable relative to the chassis.

In another aspect, the disclosure describes a method of adjusting a push-roller assembly comprising sensing a distance between a portion of a machine and a target, and transmitting the distance to a controller. The method also involves comparing on the controller the distance to a predetermined range and determining on the controller an extension value according to the distance. The method also includes extending the push-roller according to the extension value when the distance is greater than the predetermined range, and retracting the push-roller assembly according to the extension value when the distance is less than the predetermined range.

DETAILED DESCRIPTION

Figure 1:
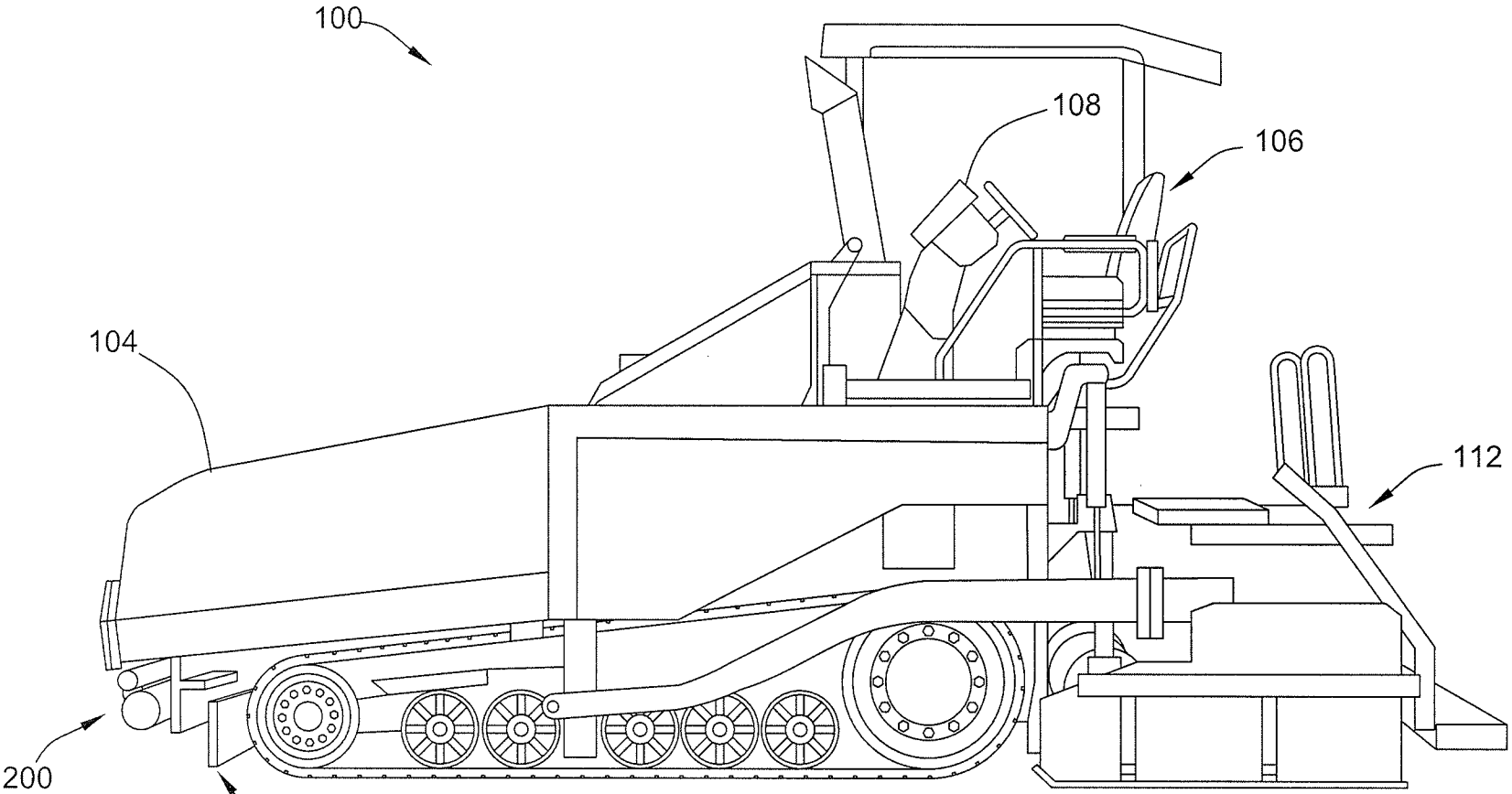
FIG. 1 is a side view of one example of a machine including an automatically adjusting push-roller assembly in accordance with the disclosure.

This disclosure relates to an automatically adjustable push-roller apparatus for a paving machine. FIG. 1 illustrates an embodiment of a paving machine 100 used in industrial applications to apply asphalt to roadways or other surfaces. The paving machine 100 has a push-roller assembly 200, a hopper 104, a operator station 106, and a screed assembly 112. The operator station 106 includes a control console 108 used by a machine operator to control operation of the paving machine 100. During operation of the paving machine 100, the hopper 104 receives paving material from a dump truck 110, such as the truck illustrated in FIG. 2. The paving machine 100 processes the paving material and deposits it onto a work surface through the screed assembly 112.

Figure 2:
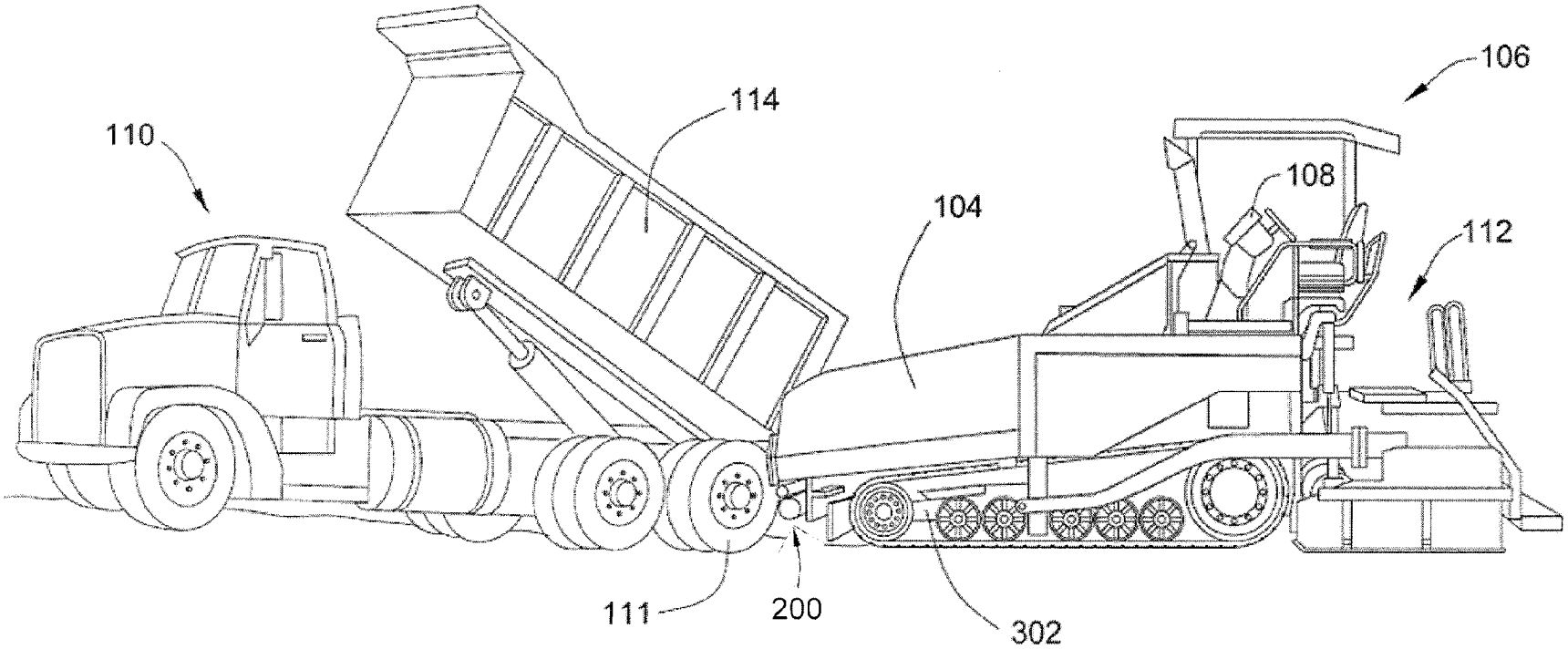
FIG. 2 is a side view of a machine and a dump truck during a material transfer process in accordance with the disclosure.

When transferring paving material from the bed 114 of the dump truck 110 to the paving machine 100, the dump truck first lines up with the hopper and assumes a proper distance such that its bed is positioned adjacent to and over a material receiving portion of the hopper 104. This requires the dump truck 110 to back up with the bed 114 full of paving material toward the hopper 104 of the paving machine until the rear tires 111 of the truck contact the push-roller assembly 200. At that time, the dump truck 110 operator can elevate the bed 114, such as is illustrated in FIG. 2, and gradually deposit the paving material into the hopper 104. Material deposition into the hopper 104 occurs gradually as the machine 100 moves, while pushing the dump truck 110, along the surface to be paved. The rate at which material is deposited into the hopper 104 depends on the thickness of the layer of material that is deposited by the screed assembly 112.

Proper alignment and positioning of the dump truck 110 and its bed 114 relative to the hopper 104 involves the proper positioning of the push-roller assembly 200. Dump trucks 110 are manufactured in many different sizes and configurations, and thus the correct position of the push-roller assembly 200 may vary based on the configuration of each dump truck making a paving material delivery. For this reason, the position of the push-roller assembly 200 with respect to the hopper 104 and the rest of the paving machine 100 is adjustable.

Figure 3:
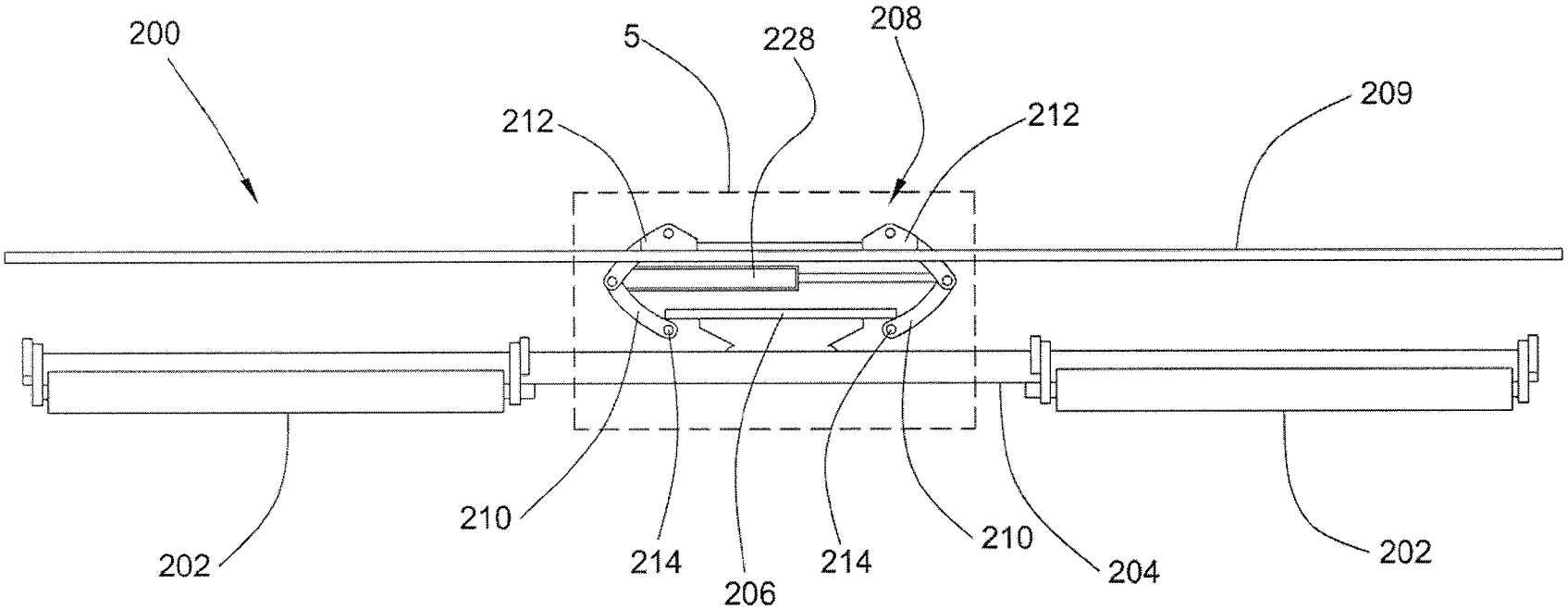
FIG. 3 is a top view of a push-roller assembly in accordance with the disclosure.
Figure 4:
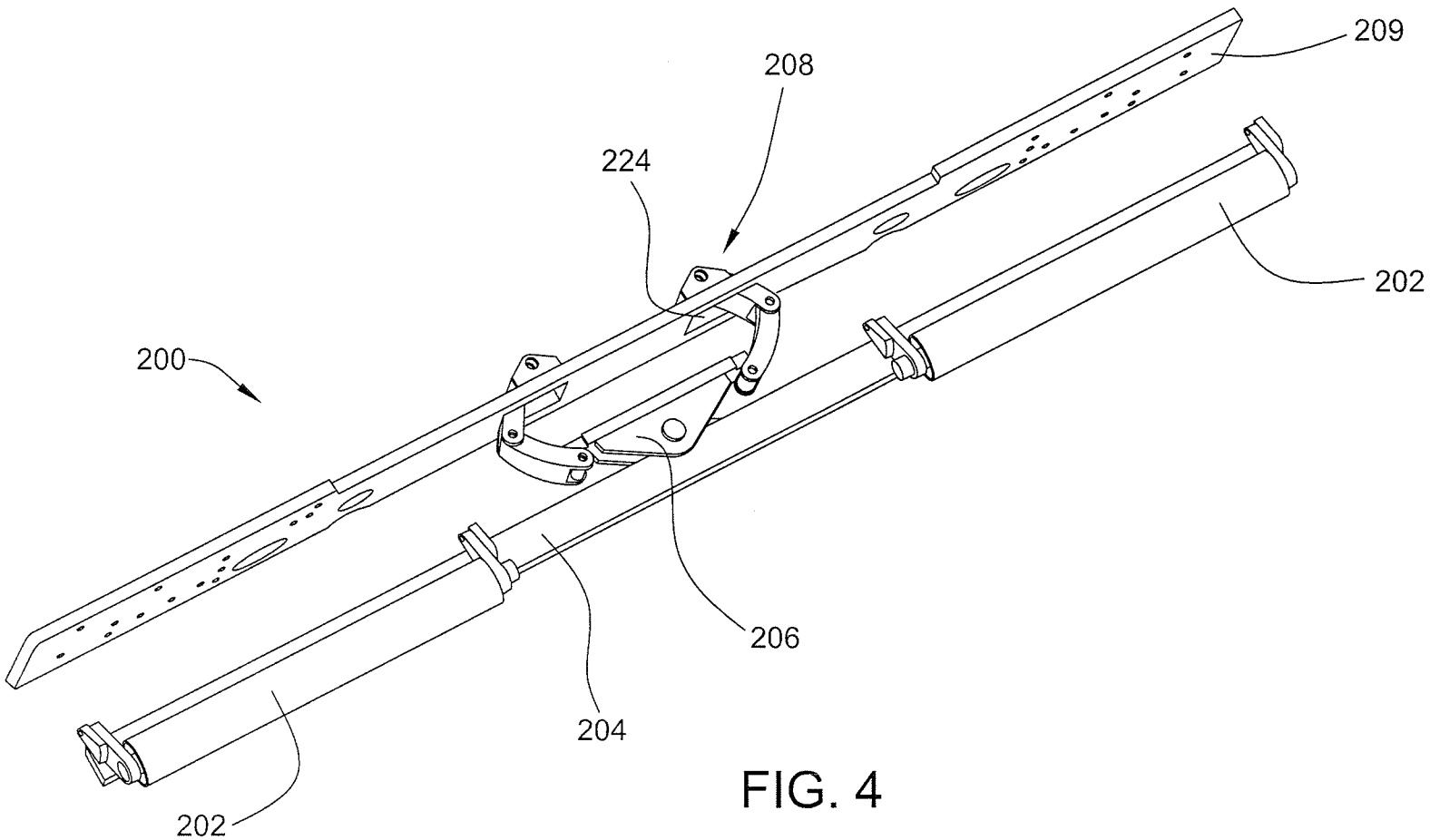
FIG. 4 is a perspective view of the push-roller assembly of FIG. 3.
Figure 5:
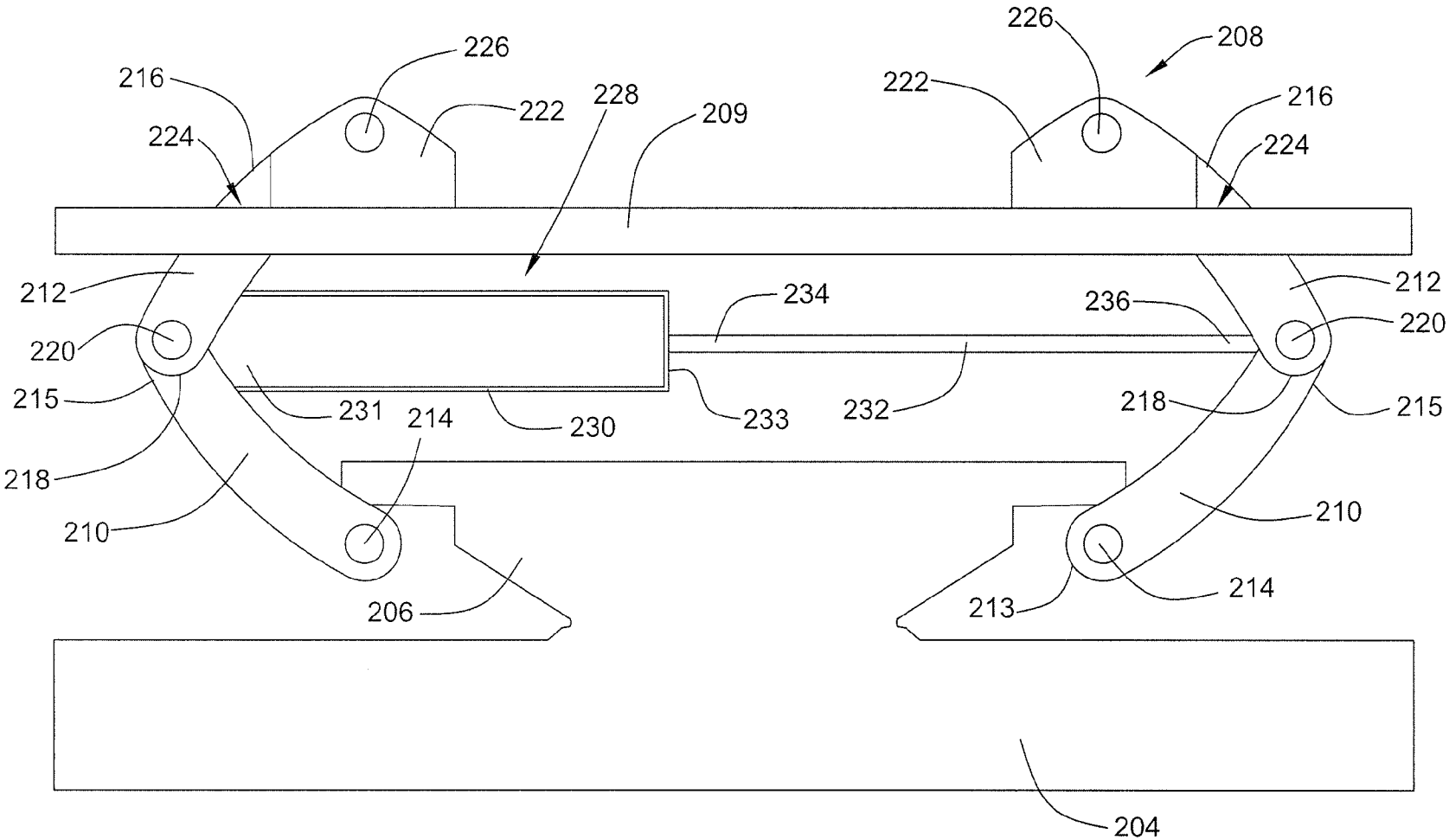
FIG. 5 is a detailed view of a linkage assembly of the push-roller assembly of FIG. 3 in a retracted position.

FIG. 3 illustrates an embodiment of the push-roller assembly 200. The push-roller assembly has rollers 202 attached to a support frame 204. The support frame 204 includes a bracket 206 that connects the support frame to a linkage assembly 208. The linkage assembly is connected to a support plate 209. FIG. 5 shows a more detailed illustration of the linkage assembly 208 and its connections. In the illustrated embodiment, the linkage assembly 208 includes two bracket arms 210 and two support arms 212. Each of the bracket arms 210 has a bracket end 213 and a linkage end 215. The bracket end 213 of each bracket arm 210 connects to the bracket 206 at a bracket pivot 214 such that the bracket arms can pivot with respect to the bracket. Each of the support arms 212 has a support end 216 and a linkage end 218. The linkage end 218 of each support arm 212 connects to the respective linkage end 215 of a bracket arm 210 at a linkage pivot 220 to allow for pivotal movement between the bracket arm and the support arm. The support plate 209 has two support brackets 222 and two slots 224. The support arms 212 pass through the slots 224 so that the support ends 216 of each support arm can connect to the support brackets 222 at a support pivot 226, around which the support arm can pivot with respect to the support bracket. The bracket pivot 214, the linkage pivot 220, and the support pivot 226 can be embodied as pins, rivets, bushings, or any other type of suitable pivoting connection mechanism. As shown, the linkage assembly 208 acts as a scissor-lift mechanism to allow the support frame 204 and rollers 202 to move towards and away from the support plate 209 as the bracket arms 210 pivot with respect to the bracket 206 and the support arms 212, and the support arms pivot with respect to the bracket anus and the support brackets 222.

Figure 6:
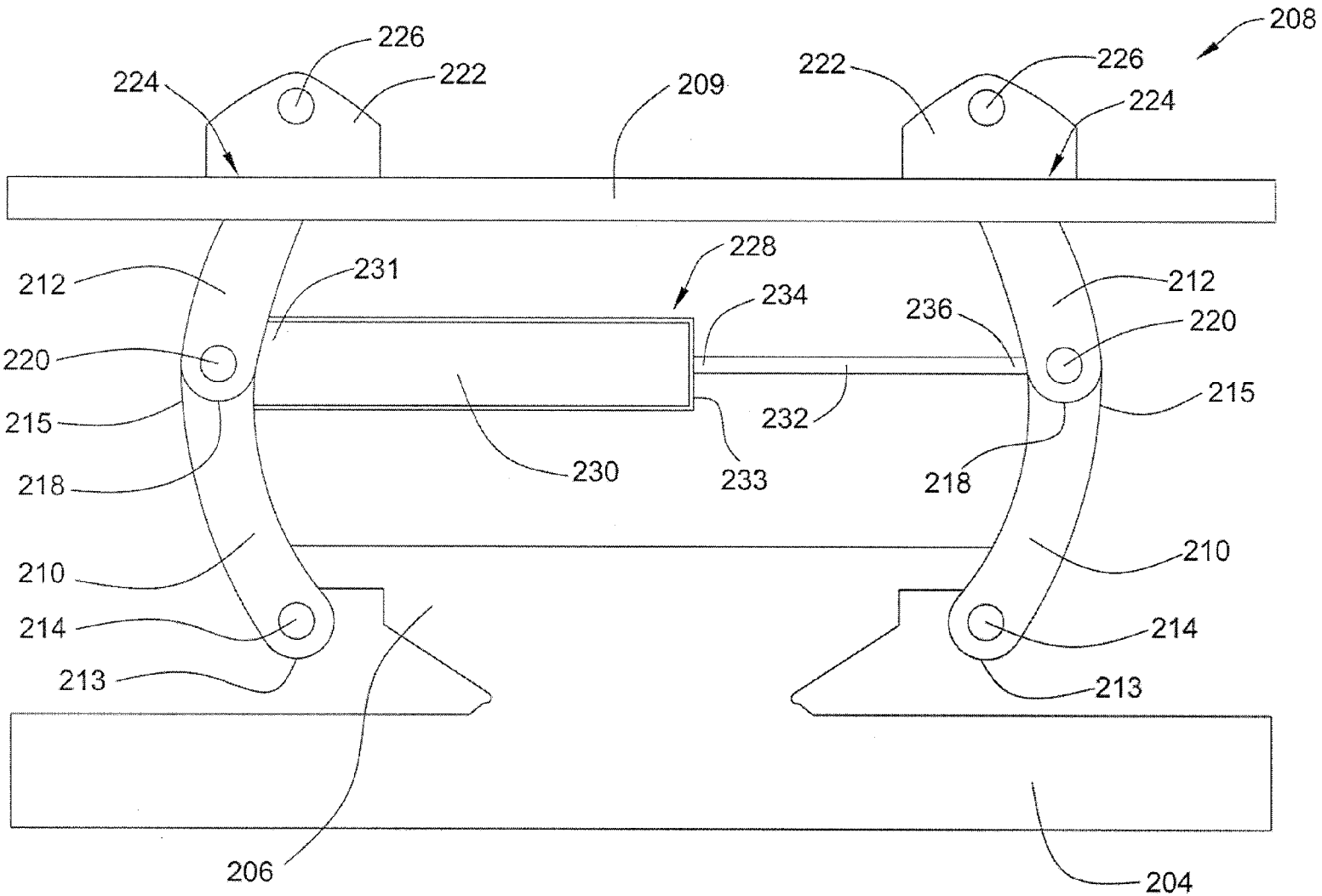
FIG. 6 is a detailed view of the linkage assembly of FIG. 5 in an extended position.

The linkage assembly 208 also includes an actuator 228. The embodiment of the linkage assembly 208 illustrated in FIG. 3, FIG. 5, and FIG. 6 shows the actuator 228 as a hydraulic cylinder assembly connected between linkage pivots 220. Alternatively, an electric motor or other suitable powered mechanism can be used. The illustrated embodiment of the actuator 228 includes a cylinder 230 having a first end 231 and a second end 233. A plunger 232 is slidably and sealably mounted within a bore of the cylinder 230. A first end 234 of the plunger 232 protrudes past the second end of the cylinder 230. The first end 231 of the cylinder 230 connects to one linkage pivot 220, while the second end 236 of the plunger 232 connects to the other linkage pivot. When the plunger 232 moves into the cylinder 230, a distance between the first end 231 of the cylinder and the second end 236 changes to pull the linkage pivots 220 toward one another. As the linkage pivots 220 move toward one another, the support arms 212 and bracket arms 210 pivot with respect to one another, extending the linkage assembly 208 to move the bracket 206, support frame 204, and rollers 202 away from the support plate 209. Conversely, when the plunger 232 moves out of the cylinder 230, the first end 231 of the cylinder extends away from the second end 236 of the plunger, thus pushing the linkage pivots 220 away from one another. As the linkage pivots 220 move away from one another, the support arms 212 and the bracket arms 210 pivot with respect to one another, retracting the linkage assembly 208 to move the bracket 206, support frame 204, and the rollers 202 toward the support plate 209. The linkage assembly 208 is shown in a substantially retracted position in FIG. 5 and in a substantially extended position in FIG. 6 for illustration.

Although the actuator 228 is shown connected between the linkage pivots 220, alternative connections can also be made. For example, the actuator 228 can be pivotally connected to the support plate 209 instead of the respective linkage pivot 220. In this alternative embodiment, the first end 231 of the cylinder 230 can pivot relative to the support plate 209, and the second end 236 of the plunger 232 can be connected to one of the support arms 212, such that an extension or retraction of the actuator 228 will still operate the scissor lift mechanism. In another example, the first end 231 of the cylinder 230 can be pivotally connected to the bracket 206, and the second end 236 of the plunger 232 can be connected to the bracket arm 210. In this way, the second end 233 of the cylinder 230 can move away from the bracket 206 as the plunger 232 moves into the cylinder to extend the linkage assembly 208.

Further, a cam connection can be used to augment actuator force. In one exemplary implementation, the actuator 228 can be connected to the support plate 209 and the second end of the plunger can be connected to one of the support arms through a cam connection. The cam connection between the second end of the plunger and the support arm 212 can allow the second end of the plunger to move with respect to the support arm to account for the changing respective positions between the support arm and the cylinder as the plunger moves into and out of the cylinder. In a similar alternative implementation, the cylinder can be connected to the bracket and the second end of the plunger can be connected to one of the bracket arms with a cam connection. As the plunger moves into the cylinder, the plunger will pull the bracket arm towards the cylinder, which extends the linkage assembly 208 and moves the bracket 206, support frame 204, and rollers 202 away from the support plate 209. In some embodiments, the linkage assembly 208 can include one or more support arms 212, and the chassis end 216 can be pivotally connected to the support plate 209 and the linkage end 218 can be pivotally connected to the support frame 204 or bracket 206. In such embodiments, the second end 236 of the plunger 232 can be pivotally connected to the support arm 212 and the cylinder 230 can be pivotally connected either the support plate 209 or the support frame 204.

Figure 7:
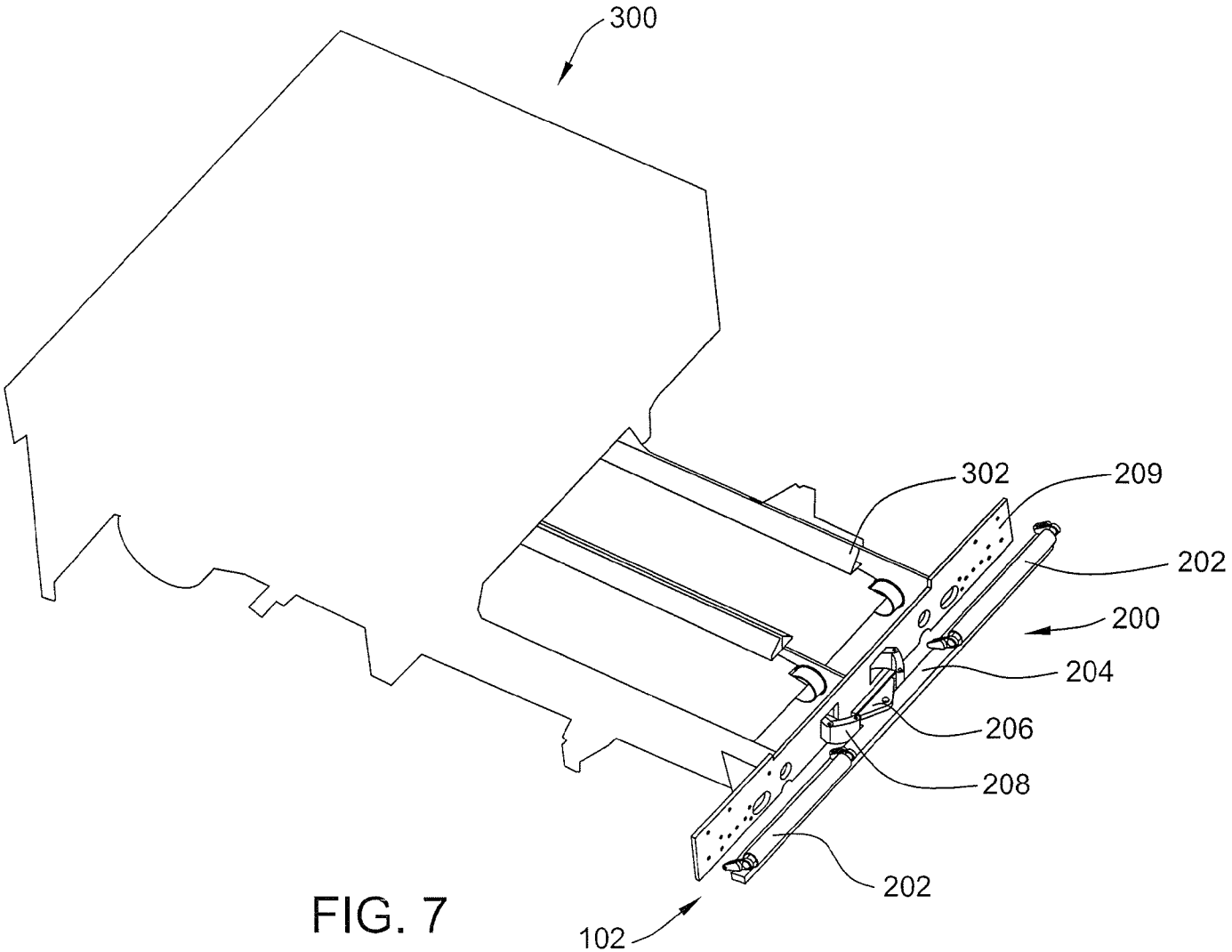
FIG. 7 is a perspective view of a chassis of the machine of FIG. 1.

FIG. 7 illustrates the chassis 300 of an embodiment of the paving machine 100 with a push-roller assembly 200 attached. The support frame 209 connects to a front end 302 of the chassis 300 such that the linkage assembly 208 can extend and move the rollers 202 away from the chassis. In some embodiments, the support frame 209 is part of the front end 302 of the chassis 300. As is illustrated in FIG. 1 and FIG. 2, the hopper 104 is located at the front end 302 of the paving machine 100, just above the push-roller assembly 200. In some embodiments, the support arms 212 pivotally connect directly to the front end 302 of the chassis 300.

Figure 8:
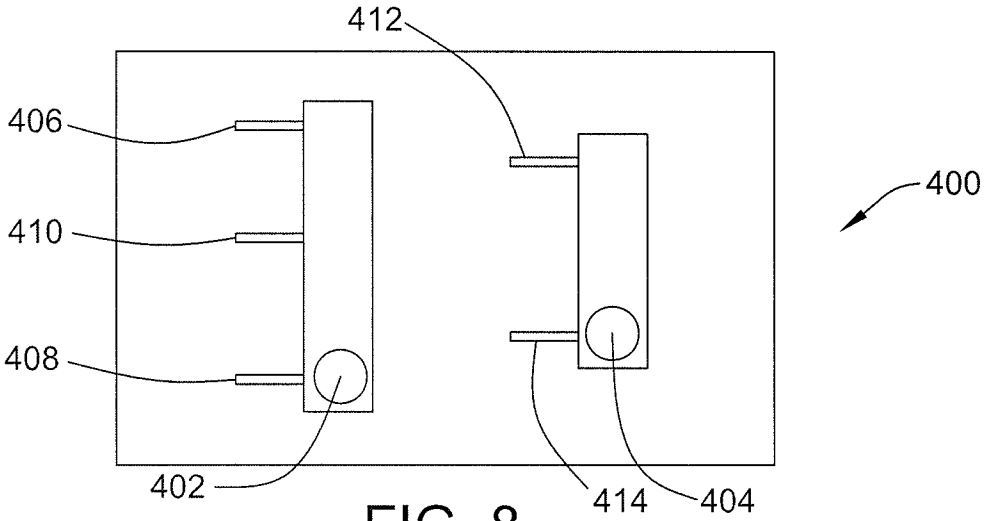
FIG. 8 is schematic view of controls of the machine of FIG. 1.
Figure 9:
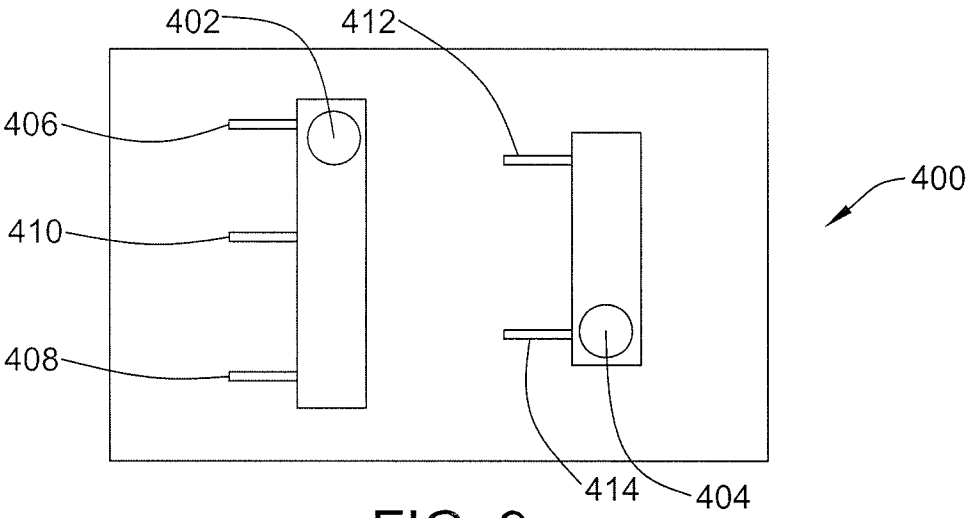
FIG. 9 is another schematic view of the controls of FIG. 8.

The control console 108 on the paving machine 100 includes controls 400 that the operator can use to move the push-roller assembly 200 relative to the chassis 300. FIG. 8 and FIG. 9 illustrate a schematic of an embodiment of the controls 400. The controls 400 include an operator control device 402 and an automatic switch 404. The operator control device 402 can indicate various functions, including an extend function, a retract function, and a hold or neutral function. These functions can be carried out by placing the operator control device 402 into, respectively, an extend position 406, a retract position 408, and a neutral position 410. The automatic switch 404 includes an "on" position 412 and an "off" position 414. FIG. 8 illustrates an embodiment of the controls 400 with the operator control device 402 in the retract position 408 and the automatic switch 404 in the off position 414. FIG. 9 illustrates an embodiment of the controls 400 with the operator control device 402 in the extend position 406 and the automatic switch 404 in the off position 414. The operator control device 402 is used in manual mode, and the automatic switch 404 is used in automatic mode. Both the manual mode and an automatic mode are explained in further detail below.

In the embodiment illustrated in FIG. 8 and FIG. 9, the controls 400 are in manual mode when the automatic switch 404 is in the off position 414. It is contemplated that the controls 400 can take many different forms. Accordingly, the switches illustrated in the figures are exemplary and can take different forms such as pedals, levers, rotary switches, and others. In manual mode, the distance between the push-roller assembly 200 and the chassis 300 is controlled directly by the paving machine 100 operator. If the push-roller assembly 100 needs to be extended away from the chassis 300, the operator may moves the operator control device 402 into the extend position 406. When the operator control device 402 is in the extend position 406, an actuator controller 418, illustrated schematically in FIG. 10, can be used to activate an actuator of the push-roller assembly 200 and cause the push-roller assembly 200 to move away from the chassis 300. The actuator controller 418 can be a valve, an electronic controller, or any other mechanism that is compatible with the type of actuator used. For example, in the embodiment previously described that includes a hydraulic piston actuator, the actuator controller 418 may be a series of hydraulic valves that port pressurized fluid to one side or the other of the hydraulic piston, thus causing the piston to move in the known fashion. In this embodiment, activation of an extend function of the actuator controller 418 will cause the application of pressure to the hydraulic piston tending to extend the plunger, which will in turn cause the linkage assembly 208 to extend and move the rollers 202 away from the chassis 300. If the operator needs to retract the push-roller assembly 100, the operator may set the operator control device 402 to the retract position 408. Setting the operator control device 402 to the retract position 408 will cause a pressure reversal tending to retract the plunger and move the push-roller assembly 200 closer to the chassis 300. Setting the operator control device 402 to the neutral position 410 may activate a hold function of the actuator controller 418, which in the illustrated embodiment may seal pressurized fluid into the hydraulic cylinder thus holding a then current position of the actuator 228. It is contemplated that the specific mechanism for extending, retracting or holding the position of an actuator will be adjusted based on the type of actuator used. For example, in a motor-driven actuator, a brake may be activated for holding a position.

To activate automatic mode, the operator sets the automatic switch 404 to the on position 412. In some embodiments, automatic mode will override manual mode when the automatic switch 404 is in the on position 412 regardless of the position of the operator control device 402. Additionally, in some embodiments, the automatic switch 404 does not have separate on and off positions. Instead, the automatic switch 404 can be a single button that, when pressed, activates automatic mode and, when pressed a second time, deactivates automatic mode. In such an embodiment, if the paving machine 100 goes through a power cycle or if the paving machine's propel mode is changed, the controls 400 will be set back to manual mode.

Figure 10:
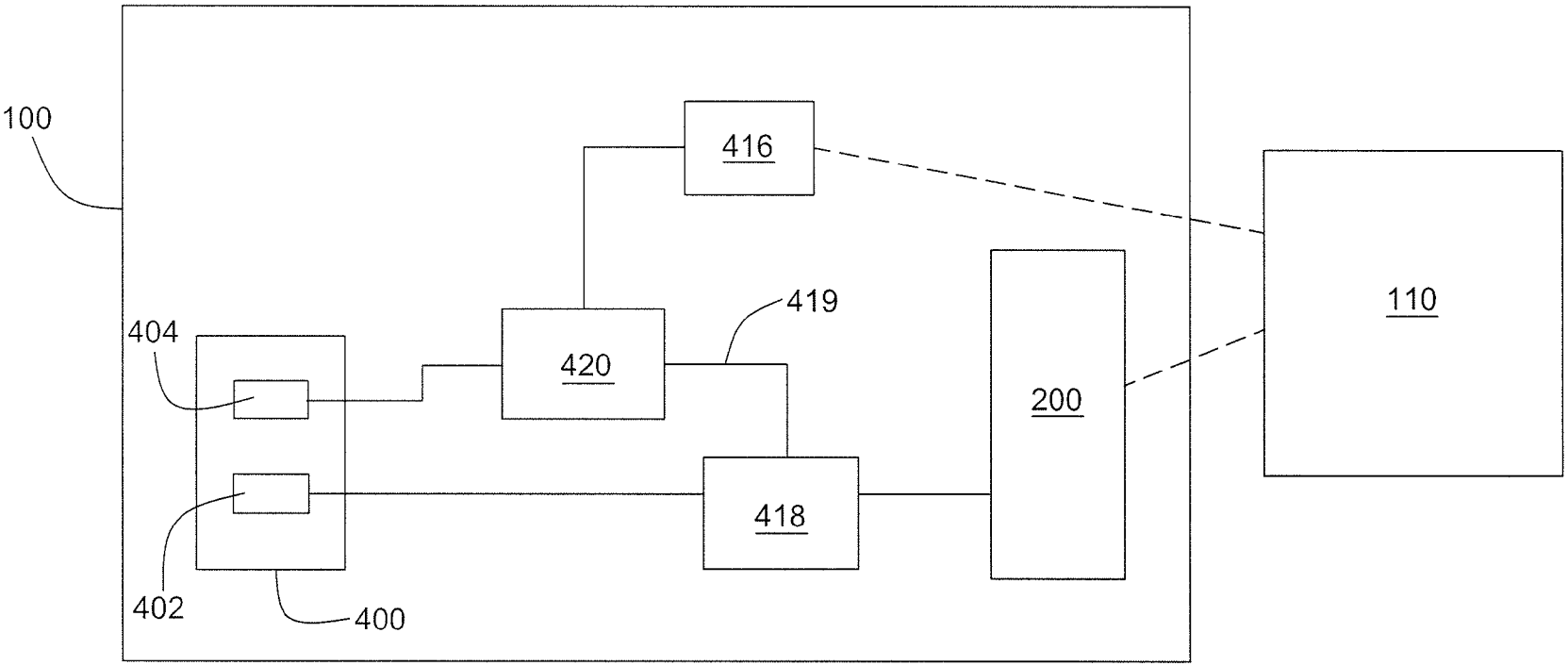
FIG. 10 is a schematic view of a control system of the machine in FIG. 1.

When in automatic mode, the position of the push-roller assembly 200 relative to the chassis 300 automatically adjusts using a location sensor 416 positioned on the front end 302 of the paving machine 100, for example, on the hopper 104, the support plate 209, or any other suitable location. The location sensor 416 can be a proximity sensor, a displacement sensor, a video sensor, an infrared sensor, a laser interrupt system, or any other type of sensor that can detect and quantify the relative distance between the truck bed and the hopper. In some embodiments, multiple sensors can be implemented to determine the changing relative position of the dump truck 110 and bed 114 over time. Alternatively, the location sensor 416 can be a bar, rod, or other extension that physically contacts the dump truck 110 and that is associated with a displacement sensor that provides a signal indicative of the position of the extension, and thus the truck, relative to the machine. As schematically illustrated in FIG. 10, the location sensor 416 is operatively connected to an electronic control module (ECM) 420 through conduits 419. The conduits 419 also connect the ECM 420, the location sensor 416, the controls 400, the actuator controller 418, and the push-roller assembly 200 to one another. In embodiments where the actuator 228 is a hydraulic mechanism, hydraulic lines operatively connect the actuator controller 418 to the actuator.

In one exemplary method of use, the push-roller assembly 208 can be kept in a fully extended position away from the chassis 300 when no dump truck 110 is engaging the paving machine 100. When a dump truck 110 approaches the front end 302 of the paving machine 100, the location sensor 416 may sense the dump truck's position relative to the hopper 104 and the front end and provide a signal indicative of that distance to the ECM 420. As the rear tires 111 of the dump truck 110 begin to engage the rollers 202, the ECM 420 will provide command signals for retracting the push-roller assembly 208 until the location sensor 416 provides an indication that the bed 114 of the dump truck is properly positioned with respect to the hopper 104. The ECM 420 can retract the push-roller assembly 208 by activating the retract function of the actuator controller 420, which moves the plunger 232 out of the cylinder 230. When the location sensor 416 senses that the bed 114 is properly positioned, the ECM 420 activates the neutral function of the actuator controller 418, which holds the push-roller assembly 208 in position while the dump truck 110 transfers paving material into the hopper 104. The ECM 420 maintains the neutral function until the dump truck 110 has disengaged from the paving machine 100. Maintenance of the neutral function can be static, for example, where the actuator extension state is locked, or dynamic, for example, by continuously adjusting the extension state of the actuator 228 to maintain the distance between the dump truck 110 and the machine 100 within a predetermined range. In the case of dynamic control of the neutral function, the distance signals provided by the location sensor 416 may be used as feedback to provide closed-loop control over the distance between the dump truck 110 and the machine 100. This type of closed-loop control can be especially useful when the machine 100 is pushing the dump truck 110 over uneven terrain, for example, terrain having different upward, downward, or changing grades. In some embodiments, the operator can input into the ECM 420 the specific target vehicle type delivering material to the paving machine 100. In such embodiments, the ECM 420 refers to a database that matches the vehicle type to a predetermined range, distances, or other values required for engaging the specific vehicle type. These values are then used in engaging the paving machine 100 and the specific vehicle.

When material deposition has been completed, the dump truck 110 will typically drive away from the machine 100 under its own power. In such instances, the ECM 420 may determine that the dump truck 110 has disengaged from the paving machine 100 by using the location sensor 416 signal that the bed 114 has moved past a certain position away from the hopper 104, for example, beyond a deadband distance, as an indication that the truck has pulled away. In one embodiment, the deadband distance coincides with the maximum extension of the push-roller assembly 200 relative to the machine 100. In other words, when the ECM 420 determines that the push-roller assembly 200 is fully extended and the position of the bed 114 relative to the hopper 104 is no longer controllable, the ECM 420 may hold the push-roller assembly in that position and provide a visual, audible and/or other indication to the operator that the dump truck 110 has disengaged the machine 100.

INDUSTRIAL APPLICABILITY

The industrial applicability of the apparatus and methods for an automatically adjusting push-roller in a machine as described herein should be readily appreciated from the foregoing discussion. The present disclosure is applicable to any type of machine using a push-roller assembly. It is particularly useful in machines that engage trucks of varying sizes to ensure accurate positioning of a truck relative to the machine. The operator can manually adjust the push-roller position electronically or the machine can automatically adjust the push-roller position as necessary.

The disclosure, therefore, is applicable to many different machines and environments. One exemplary machine suited to the disclosure is a track asphalt paver. These machines are commonly used all over the world for paving roads, lots, or any other asphalt application environment. Thus, an automatically adjusting push-roller allows these machines to adapt for engagement to a variety of different trucks.

Further, the apparatus and methods above can be adapted to a large variety of machines. For example, other industrial machines, such as wheel asphalt pavers and many other machines can benefit from the methods and systems described.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A machine comprising:

a chassis;

a push-roller assembly connected to the chassis, the push-roller assembly adapted to engage a vehicle, the push-roller assembly comprising:

a support frame that is linearly displaceable relative to the chassis;

at least one roller connected to the support frame, wherein the at least one roller is adapted to engage the vehicle;

at least one support arm including a chassis end and a linkage end, the linkage end pivotally connected to the support frame and the chassis end pivotally connected to the chassis such that the support frame is movable relative to the chassis when the support arm pivots with respect to the chassis and the support frame; and an actuator connected to the support arm, the actuator adapted to cause the support arm to pivot with respect to the chassis and support frame such that the support frame is linearly displaceable relative to the chassis in response to command signals from an electronic control module; and a location sensor providing a location signal indicative of a linear distance between the chassis and the vehicle;

wherein the electronic control module is configured to determine the command signals based on the location signal and send the command signals to the actuator to set the linear distance between the chassis and the vehicle such that a desired linear distance between the chassis and the vehicle is maintained continuously during operation of the machine.

2. The machine of claim 1, further comprising:

at least one bracket arm including a bracket end and a linkage end, the linkage end of the at least one bracket arm being pivotally connected to the linkage end of the at least one support arm and the bracket end being pivotally connected to the support frame.

3. The machine of claim 2, wherein the actuator comprises:

a hydraulic cylinder including a first end and a second end; and a plunger slidably disposed in the hydraulic cylinder, the plunger including:

a first end adapted to move partially into and partially out of the second end of the hydraulic cylinder; and a second end pivotally connected to the at least one support arm;

wherein the at least one support arm is adapted to rotate with respect to the chassis and the support frame when the first end of the plunger moves partially into or partially out of the second end of the hydraulic cylinder.

4. The machine of claim 3, wherein the push-roller assembly further comprises two bracket arms and two support arms.

5. The machine of claim 4, wherein the first end of the hydraulic cylinder is pivotally connected to one of the support arms and the second end of the plunger is pivotally connected to the other support arm such that when the first end of the plunger moves partially into the second end of the hydraulic cylinder, the two support arms pivot with respect to the chassis and the support frame causing the linkage ends of the two support arms to move toward one another and move the support frame away from the chassis, and when the first end of the plunger moves partially out of the second end of the hydraulic cylinder, the two support arms pivot with respect to the chassis and the support frame causing the linkage ends of the two support arms to move away from one another and move the support frame toward the chassis.

6. The machine of claim 5, further comprising an operator control device disposed to provide command signals to the actuator, the operator control device being configured to command an extend function and a retract function, wherein the extend function operates to cause the actuator controller to move the push-roller assembly away from the chassis, and the retract function operates to cause the actuator controller to move the push-roller assembly toward the chassis.

7. A push-roller assembly adapted to engage a vehicle, the push-roller assembly comprising:

a support frame that is linearly displaceable relative to a machine;

at least one roller connected to the support frame, wherein the at least one roller is adapted to engage the vehicle;

at least one support arm including a chassis end and a linkage end, the linkage end pivotally connected to the support flame and the chassis end adapted to be pivotally connected to a chassis such that the support frame is movable relative to the chassis when the support arm pivots with respect to the chassis and support frame; and an actuator connected to the support arm, the actuator adapted to cause the support arm to pivot with respect to the chassis and the support frame such that the at least one roller support frame is linearly displaceable relative to the chassis in response to command signals from an electronic control module;

wherein the electronic control module is configured to determine the command signals based on signals indicative of a linear distance between the machine and the vehicle, and send the command signals to the actuator to set the linear distance between the machine and the vehicle such that a desired linear distance between the machine and the vehicle is maintained continuously during operation of the machine.

8. The push-roller assembly of claim 7, further comprising:

at least one bracket arm including a bracket end and a linkage end, the linkage end of the at least one bracket arm being pivotally connected to the linkage end of the at least one support arm and the bracket end being pivotally connected to the support frame.

9. The push-roller assembly of claim 8, wherein the actuator comprises:

a hydraulic cylinder including a first end and a second end; and a plunger slidably disposed in the hydraulic cylinder, the plunger including:

a first end adapted to move partially into and partially out of the second end of the hydraulic cylinder; and a second end pivotally connected to the at least one support arm;

wherein the at least one support arm is adapted to rotate with respect to the machine and the support frame when the first end of the plunger moves partially into or partially out of the second end of the hydraulic cylinder.

10. The push-roller assembly of claim 9, further comprising two bracket arms and two support arms.

11. The push-roller assembly of claim 10, wherein the first end of the hydraulic cylinder is pivotally connected to one of the support arms and the second end of the plunger is pivotally connected to the other support arm such that when the first end of the plunger moves partially into the second end of the hydraulic cylinder, the two support arms are adapted to pivot with respect to the machine and the support frame causing the linkage ends of the two support arms to move toward one another and move the support frame away from the machine, and when the first end of the plunger moves partially out of the second end of the hydraulic cylinder, the two support arms are adapted to pivot with respect to the machine and the support frame causing the linkage ends of the two support arms to move away from one another and move the support frame toward the machine.

12. The push-roller assembly of claim 11 wherein the actuator is further adapted to be operatively associated with an actuator controller disposed to receive command signals from an operator control device, the operator control device being configured to command an extend function and a retract function, and wherein the extend function operates to cause the actuator controller to move the push-roller assembly away from the machine, and the retract function operates to cause the actuator controller to move the push-roller assembly toward the machine.

* * * * *